United States Patent [19]

Service

[11] Patent Number: 4,714,305

[45] Date of Patent: Dec. 22, 1987

[54] SPICE RACK

[76] Inventor: Robert S. Service, 1914 Selby Ave., Los Angeles, Calif. 90025

[21] Appl. No.: 897,018

[22] Filed: Aug. 15, 1986

[51] Int. Cl.[4] ..... A47B 88/04

[52] U.S. Cl. ..... 312/306; 211/74; 312/312; 312/317 R

[58] Field of Search ..... 312/301, 308, 309, 310, 312/298, 317, 312; 211/74

[56] References Cited

U.S. PATENT DOCUMENTS

| | | | |
|---|---|---|---|
| 1,108,082 | 8/1914 | Pennock | 312/301 X |
| 2,372,077 | 3/1945 | Glinecki | 312/308 |
| 2,769,676 | 11/1956 | Larsen et al. | 312/317 R |
| 2,885,253 | 5/1959 | Kesling | 312/312 X |
| 3,297,387 | 1/1967 | Parsons | 312/312 X |
| 3,970,010 | 7/1976 | Cantley | 312/298 X |
| 4,378,070 | 3/1983 | Matheis | 211/134 X |

*Primary Examiner*—Joseph Falk

*Attorney, Agent, or Firm*—Cislo & Thomas

[57] ABSTRACT

A spice rack assembly is provided comprising three sections, a hollow outer cabinet open on one side, a hollow inner receptacle member open at the top and adapted to slide laterally through the side opening of the outer cabinet, and a spice rack member adapted to slide vertically through the top opening of the inner receptacle member. The spice rack assembly is sized to fit behind or along side a major appliance, such as a range or refrigerator, and to position the spice rack at approximately eye level in the extended position.

9 Claims, 4 Drawing Figures

Fig. 1.

SPICE RACK

BACKGROUND OF THE INVENTION

The present invention relates to spice racks, and, more particularly, to a compact spice rack.

Herbs and spices are increasingly commercially available, due, no doubt, to the addition to the population in the United States of refugees from Southeast Asia and other countries. While in the past, a kitchen might boast the presence of nutmeg, cinnamon and a few other spices, cooks have discovered the subtle flavors imparted by coriander, cardamom, saffron, and other more exotic herbs and spices not heretofore as readily available. Also, spice mixtures, such as lemon pepper, cheese/herbs, and others now proliferate the shelves of supermarkets.

The profusion of such a variety of herbs and spices and mixtures poses a dilemma for the homeowner who may not have adequate space to store all the herbs and spices desired. While spice racks are available, they require wall space that may not be available in the highly efficient, down-sized modern homes or apartments of today. Further, many such spice racks do not have the capability of handling the different container sizes of the herbs and spices.

OBJECTS AND SUMMARY OF THE INVENTION

Accordingly, it is an object of the present invention to provide a spice rack that is capable of storing a large quantity of bottled herbs and spices.

It is another object of the present invention to provide a spice rack that is capable of storing different size containers of herbs and spices.

It is yet another object of the present invention to provide a spice rack that may be stored in the kitchen and hence readily accessible and yet collapsible for storage behind an appliance, such as a kitchen range.

These and further objects of the invention will become more readily apparent upon a consideration of the accompanying drawings taken in conjunction with the following commentary.

Briefly, a spice rack is provided, comprising three sections, an outer cabinet open on one side, an inner receptacle member open at the top and adapted to slide laterally through the side opening of the outer cabinet, and a spice rack member adapted to slide vertically throught the top opening of the inner receptacle member.

The spice rack of the invention may be stored behind or along side of a major appliance, such as a kitchen range or refrigerator, and thus does not occupy valuable kitchen space.

DETAILED DESCRIPTION OF THE INVENTION

Figure 1:
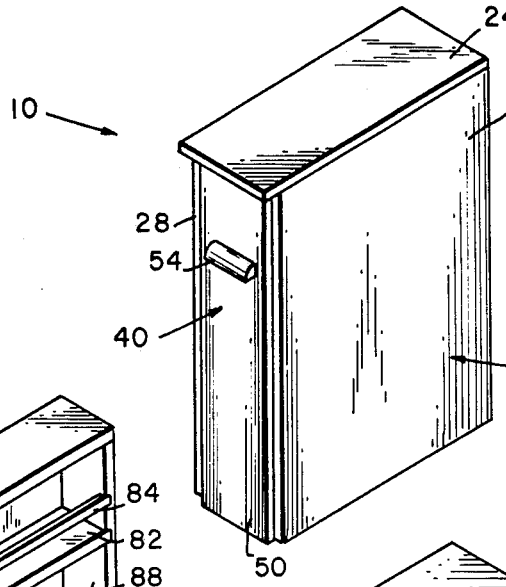
FIG. 1 is a perspective view of the spice rack assembly of the invention, shown in the closed configuration.

Referring now to the drawings, wherein like numerals of reference designate like elements throughout, a spice rack assembly is generally depicted at 10. The spice rack assembly comprises, broadly, a hollow outer cabinet 20, a hollow inner receptacle member 40 and a spice rack 80.

The outer cabinet 20 is of boxlike, rectangular construction, employing a substantially rigid material such as wood or other cellulosic material such as particle board and the like. The outer cabinet comprises a front and back (front 22 only being shown), top 24, bottom 26 and sides (side 28 only being shown).

Side 28 of the cabinet 20 is open to accept the lateral movement of the inner receptacle member 40, which may be stored inside the outer cabinet 20 or moved laterally to an extended position substantially outside the outer cabinet 20.

The inner receptacle member 40 is also of boxlike, rectangular construction, employing the same materials as the outer cabinet 20. The inner receptacle member 40 comprises a front 42, back 44, top 46, bottom 48, and sides 50, 52.

The inner receptacle member 40 is sized to fit inside the outer cabinet 20, with side 50 of the inner member fitting substantially flush with the open side 28 of the outer cabinet. Side 50 of the inner receptacle member 40 is provided with a handle 54 for grasping to pull the inner receptacle member 40 out of the outer cabinet 20 or to push the receptacle member back in, as shown by double-headed arrow A.

Figure 2:
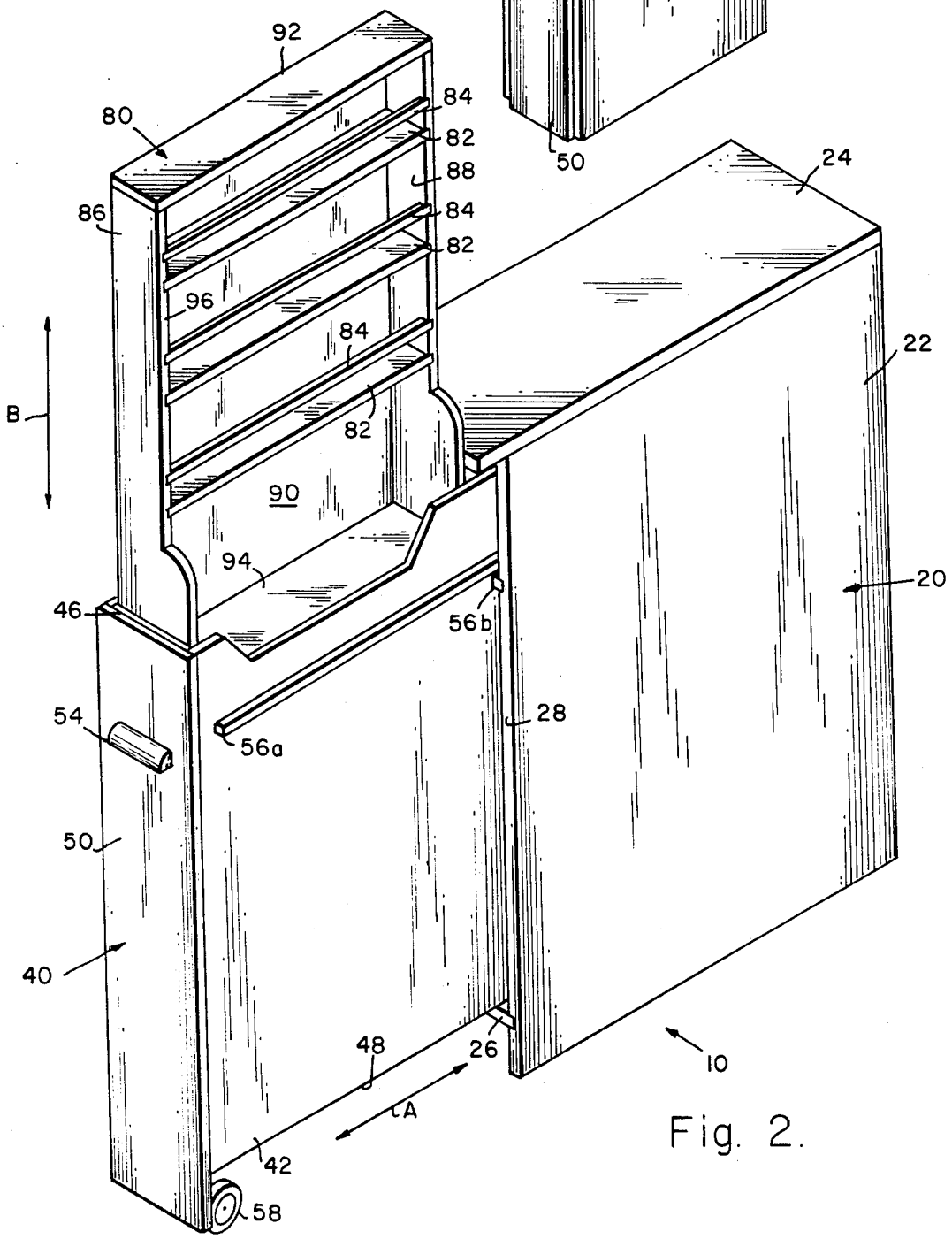
FIG. 2 is a perspective view of the spice rack assembly of the invention, shown in the open configuration.

The front 42 and back 44 of the inner receptacle member 40 and the inside of front 22 and back of the outer cabinet 20 are provided with a pair of sliding glide sets or runners (only one pair, **56*a*, 56*b*, being shown in FIG. 2**). The sliding glide set may comprise any of the well-known means of accomplishing a drawer-type sliding motion, ranging from simple wood strips to glide rollers. The particular sliding glide set employed forms no part of this invention.

The bottom 48 of the inner receptacle member 40 is also provided with a set of rollers 58 for support of the end 50 in its extended position and to allow more facile movement of the inner receptacle member 40 in and out of the outer cabinet 20.

The spice rack 80 is of substantially boxlike construction and the same materials as the outer cabinet 12 and inner receptacle member 40 and is provided with a plurality of shelves 82 and retainer members 84. The spice rack 80 is constructed of sides 86, 88, back 90, top 92 and bottom 94. The front 96 is open, providing access to the shelves 82.

Figure 3:
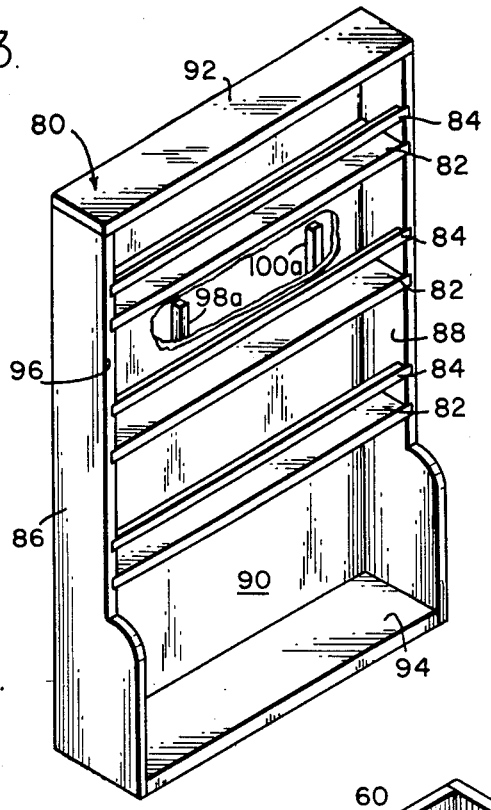
FIG. 3 is a perspective view of the spice rack itself, partially in cut-away.
Figure 4:
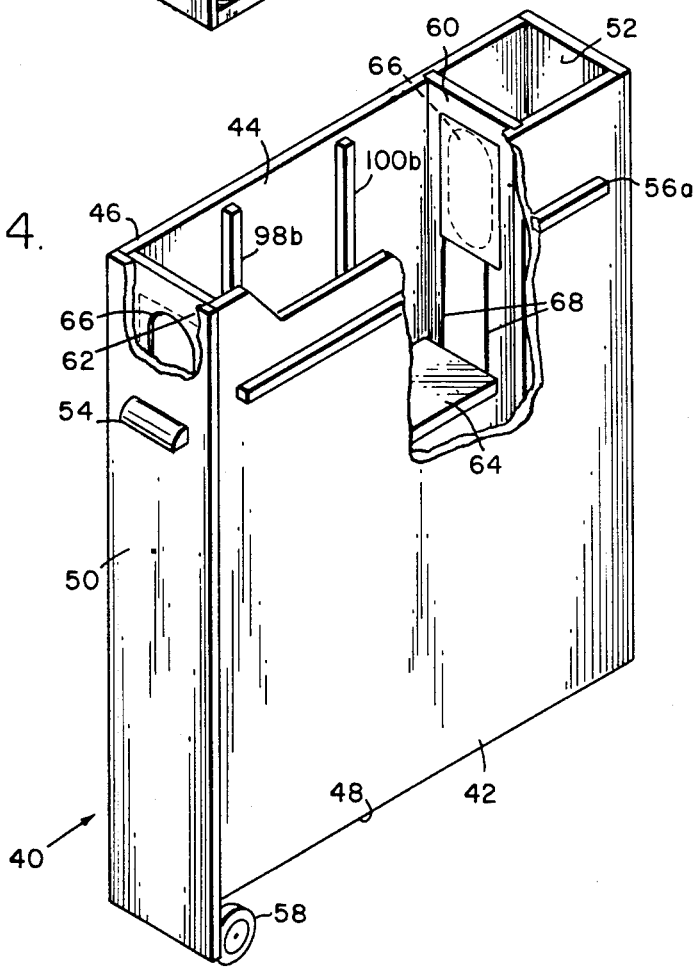
FIG. 4 is a perspective view of the inner receptacle member, partially in cut-away, showing a preferred slide arrangement for engaging the spice rack depicted in FIG. 3.

The back 90 of the spice rack 80 and the back 44 of the inner receptacle member 40 are provided with a pair of sliding glide sets **98*a*, 98*b*, 100*a*, 100*b*, as shown in FIGS. 3 and 4. As with the sliding glide sets 56*a*, 56*b***, the sliding glide set may comprise any of the well-known means of accomplishing a drawer-type sliding motion, ranging from simple wood strips to glide rollers. The particular sliding glide set employed forms no part of this invention.

The shelves 82 of the spice rack 80 may be made fixed, as shown in FIGS. 2 and 3, or may be adjustable. Either way, the spacing between shelves 82 may be set to accomodate the various size herb and spice containers.

It will be appreciated that the outer cabinet 20 is sized to substantially contain the inner receptacle member 40, but that the inner receptacle member is sized to be somewhat wider than the spice rack 80. In this manner, the inner receptacle member 40 may be extended from the outer cabinet 12 sufficiently to permit raising of the spice rack 80 without extending the inner receptacle member beyond the limits of the outer cabinet. To help prevent such unwanted extension, stoppers (not shown) may be placed on the ends of the sliding glide sets 56*a*, 56*b*, as is commonly done with sliding drawers.

In sizing the inner receptacle member 40, a first inner vertical member 60 is spaced from the end 50 to accommodate the spice rack 80. A second inner vertical member 62 is spaced just slightly in from end 50. To assist vertical movement of the spice rack 80, shown by double-headed arrow B, a horizontal support shelf 64 is provided in the inner receptacle member 40, which is operatively connected to a pair of counter-weight devices 66, mounted in the vertical members 60 and 62, near the top thereof, in opposed relationship.

To support shelf 64 is connected to the counter-weight devices 66 by means such as cables 68. Preferably, the counter-weight devices 68 are of the type that maintain the shelf 64 in whatever position is desired, such as double hung window mechanisms, based on the weight of the spice rack 80 and associated spices. An example of such preferred counter-weight devices 66 is available under the trade name Acme Twin Balance, manufactured by Duplex, Inc. (North Hollywood, Calif.).

As a example, the spice rack assembly of the invention comprises an outer cabinet 20 having dimensions $27\frac{1}{4}$ inches (W)×10 inches (D)×36 inches (H), using $\frac{3}{4}$ inch plywood for the sides and bottom and solid butcher block for the top, with a slight (2 inches) overhang over the open end 28. The inner receptacle member 40 has dimensions 27 inches (W)×$6\frac{1}{4}$ inches (D)×30 inches (H), with inner vertical member 58 spaced 6 inches in from end 52. The spice rack 80 has dimension $18\frac{3}{4}$ inches (W)×29 inches (H). The base portion is $4\frac{3}{4}$ inches (D), while the top portion is 3 inches (D). Using the counter-weight devices 66 described above, the spice rack 80, resting on shelf 64, may be raised sufficiently to permit the spices contained therein to be approximately at eye level for easy selection.

Thus, a spice rack has been disclosed. Many changes and modifications will readily occur to those of skill in the art, and all such changes and modifications are within the scope of the invention, as defined by the appended claims.

What is claimed is:

1. A spice rack assembly comprising three sections, a hollow outer cabinet open on one side and having a top wall, a hollow inner receptacle member open at the top and having substantially continuous front, back, and side walls, means to slide said inner receptacle member laterally through said side opening of said outer cabinet, a spice rack member having a back, opposite sides, and a plurality of shelf members interconnecting the opposite sides means to slide said spice rack member vertically to a predetermined position above said top wall of said hollow outer cabinet to expose at least one of said shelf members, through said top opening of said inner receptacle member subsequent to said inner receptacle being laterally slid through said cabinet open side, said means to slide said spice rack member vertically including sliding guide sets in cooperative association on the back of said spice rack member and the back of said inner receptacle member.

2. The spice rack assembly of claim 1 wherein each section is of substantially boxlike construction, having top, bottom, front, back and side portions.

3. The spice rack assembly of claim 2 wherein said inner receptacle member is provided with rollers on the bottom thereof, adjacent an end associated with said open end of said outer cabinet.

4. The spice rack assembly of claim 2 wherein the inside of said outer cabinet and the outside of said inner receptacle member are provided with a pair of sliding glide sets in cooperative association to enable said inner receptacle to slide laterally in and out of said outer cabinet.

5. The spice rack assembly of claim 2 wherein said inner receptacle member is wider than said spice rack and is provided with an interior vertical member spaced from one end of said inner receptacle member to accommodate the width of said spice rack.

6. The spice rack assembly of claim 2 wherein said inner receptacle member is provided with an interior horizontal shelf member for supporting said spice rack, said shelf member being connected to a pair of counter-weight devices mounted on opposed sides for maintaining said shelf member in a desired position.

7. A spice rack assembly comprising three sections, a hollow outer cabinet open on one side and having a continuous top wall with an inner surface, a hollow inner receptacle member open at the top having a substantially continuous frontal wall extending from the inner surface of said hollow outer cabinet top wall to a lower end portion of said hollow outer cabinet, and a spice rack member having a back, opposite sides, and a plurality of shelf members interconnecting the opposite sides, each of said sections being of substantially boxlike construction, means to slide said inner receptacle member laterally through said side opening of said outer cabinet including a sliding guide set in cooperative association on the inside of said outer cabinet and the outside of said inner receptacle member, and means to slide said spice rack member vertically through said top opening of said inner receptacle member to a predetermined position above said continuous top wall of said hollow outer cabinet to expose at least one of said shelf members, said means to slide said spice rack member vertically including sliding glide sets in cooperative association on the back of said spice rack member and the back of said inner receptacle member.

8. The spice rack assembly of claim 7 wherein said inner receptacle member is wider than said spice rack and is provided with an interior vertical member spaced from one end of said inner receptacle member to accommodate the width of said spice rack.

9. The spice rack assembly of claim 7 wherein said inner receptacle member is provided with an interior horizontal shelf member for supporting said spice rack, said shelf member being connected to a pair of counter-weight devices mounted on opposed sides for maintaining said shelf member in a desired position.

* * * * *